US005484175A

United States Patent [19]

Teich et al.

[11] Patent Number: 5,484,175

[45] Date of Patent: Jan. 16, 1996

[54] CABINET LOCK AND METHOD FOR USING SAME

[75] Inventors: Daniel E. Teich, Marion; Erick L. Sokn, Murphysboro, both of Ill.

[73] Assignee: Maytag Corporation, Newton, Iowa

[21] Appl. No.: 187,841

[22] Filed: Jan. 28, 1994

[51] Int. Cl.[6] ..... E05C 19/06

[52] U.S. Cl. ..... 292/80; 292/198; 292/DIG. 38; 411/41; 411/508

[58] Field of Search ..... 292/198, DIG. 38, 292/DIG. 53, 219, 209, 340, 80, 76; 411/41, 508

[56] References Cited

U.S. PATENT DOCUMENTS

| | | | |
|---|---|---|---|
| 2,657,894 | 11/1953 | Sklenar | 411/41 X |
| 3,476,426 | 11/1969 | Lewin | 292/76 |
| 3,592,495 | 7/1971 | Fisher | 292/DIG. 38 X |
| 3,921,253 | 11/1975 | Nelson . | |
| 4,277,196 | 7/1981 | Morel . | |
| 4,544,191 | 10/1985 | Nakama | 292/DIG. 72 X |
| 4,840,285 | 6/1989 | Carr . | |
| 4,865,366 | 9/1989 | Kretchman . | |
| 4,922,587 | 5/1990 | Pettit . | |
| 4,988,149 | 1/1991 | Mulder et al. . | |

FOREIGN PATENT DOCUMENTS

| | | | |
|---|---|---|---|
| 1355463 | 2/1964 | France | 411/41 |
| 1107756 | 3/1968 | United Kingdom | 411/41 |
| 2220978 | 1/1990 | United Kingdom | 292/340 |

*Primary Examiner*—Rodney M. Lindsey

*Attorney, Agent, or Firm*—Zarley, McKee, Thomte, Voorhees, & Sease

[57] ABSTRACT

A locking device is provided for securing a first cabinet panel member having an opening therein to a second cabinet panel member having an opening therein. The locking device includes a base flange, an upper body portion, and a lower body portion. The lower body portion is inserted into the opening in the second cabinet panel member and a plurality of spring legs engage the second cabinet panel member to lock the two together. The first cabinet panel member is moved toward the upper portion of the locking device until the upper portion of the locking device is within the opening in the first cabinet panel member. A catch pawl retentively engages the first cabinet panel member in that position. The base flange of the locking device separates the upper and lower body members from one another and isolates the first cabinet panel member from the second cabinet panel member.

10 Claims, 2 Drawing Sheets

CABINET LOCK AND METHOD FOR USING SAME

BACKGROUND OF THE INVENTION

The present invention relates to a cabinet lock and method for using same.

In the assembling of appliances, it is sometimes desirable to detachably secure two metal parts together. Examples of such situations are cabinet tops of fabric washers and dryers, stoves, or other appliances.

It is desirable to provide a locking device and method whereby the two parts can be detachably secured together quickly and easily. Another desirable feature is the ability to provide a cushion or separator between the two parts after they are secured together so that they will not vibrate against one another during operation of the appliance. It is also important to be able to detach the parts easily for maintenance and repair.

Therefore a primary object of the present invention is the provision of an improved cabinet lock and method for using same.

A further object of the present invention is the provision of an improved cabinet lock which can be quickly and easily assembled to the particular parts being joined.

A further object of the present invention is the provision of an improved cabinet lock allowing side-to-side and front-to-back registration of one cabinet member with respect to another cabinet member.

A further object of the present invention is the provision of a cabinet lock and method for using same which is efficient in operation, economical to manufacture, and durable in use.

SUMMARY OF THE INVENTION

The foregoing objects are achieved, in a preferred embodiment of the invention, by a cabinet locking device having a horizontal base flange, an upper body portion extending above the base flange, and a lower body portion extending below the base flange. The lower body portion is comprised of spaced apart spring legs which are capable of springing from a normal position spaced apart from one another to a narrowed position wherein they are closer to one another than in their normal position.

An elongated passageway extends through the upper body portion, the base flange and the lower body portion and between the spaced apart legs. A retaining peg, sized and shaped to fit within the passageway is integrally molded with the locking device, and is positioned in registered alignment above the upper end of the passageway. A thin wall portion separates the peg from the remainder of the upper body portion. Pressure applied manually such as by a hammer on the peg causes the thin wall to break and forces the peg into the passageway between the spaced apart legs.

The locking device of the present invention can be used to join a first cabinet member having a downwardly presented surface with a first aperture therein to a second cabinet member having an upwardly presented surface with a second aperture therein. The spaced apart spring legs are inserted into the second aperture to a depth where the horizontal base flange abuts against the upwardly presented surface of the second cabinet member. The relative size of the second aperture and the distance between the spring legs causes them to be forced to their narrowed position during insertion, and the spring like nature of the legs causes them to spring to their normal position after insertion. When in their normal position the spring legs retentively engage the second cabinet member and hold the locking device within the aperture of the second cabinet member. The peg is then driven downwardly in the passageway between the spring legs so as to cause the spring legs to be locked in their normal position and also to be locked to the second member.

Next the first cabinet member is lowered over the second cabinet member with the aperture in the first member surrounding and passing over the upper body portion of the locking device. The upper body portion of the locking device is provided with a catch pawl which retentively engages the first cabinet member after it has been lowered to the desired position. In this position the downwardly presented surface of the first cabinet member engages the horizontal flange of the locking device so that the horizontal flange separates the first and second members and prevents them from vibrating against one another during operation of the appliance.

DESCRIPTION OF THE PREFERRED EMBODIMENTS

Figure 1:
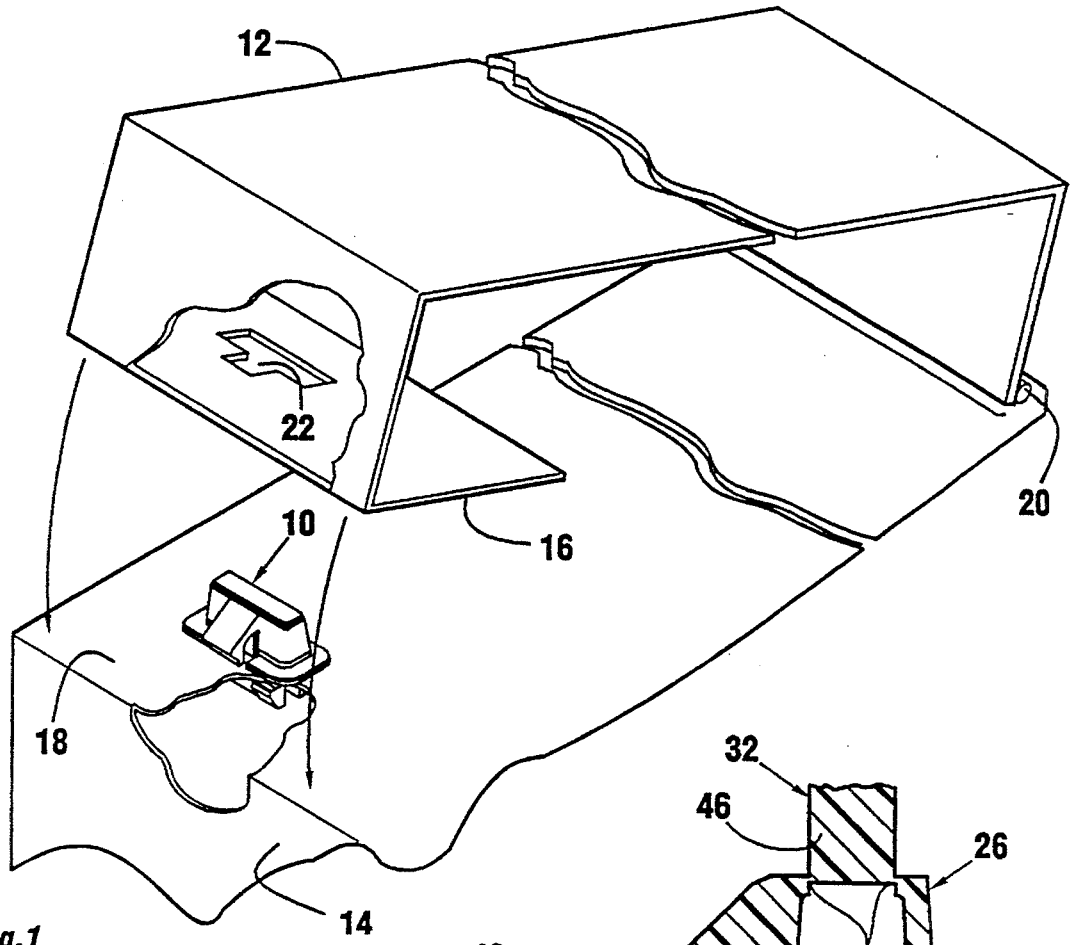
FIG. 1 is a pictorial view partially broken away, showing the locking device as it is used to join an upper cabinet member and a lower cabinet member.

Referring to the drawings, the numeral 10 generally designates the cabinet lock or locking device of the present invention. The cabinet lock 10 is shown in FIG. 1 for joining an upper cabinet member 12 to a lower cabinet member 14. Upper cabinet member 12 includes a downwardly facing surface 16 and lower cabinet member 14 includes an upwardly facing surface 18. A hinge 20 joins the two cabinet members at their rear edges, and the locking device 10 is used to join the two cabinet members 12, 14 at their forward edges. It is also possible to use a second locking device 10 at the rear edge in the place of hinge 20.

Figure 5:
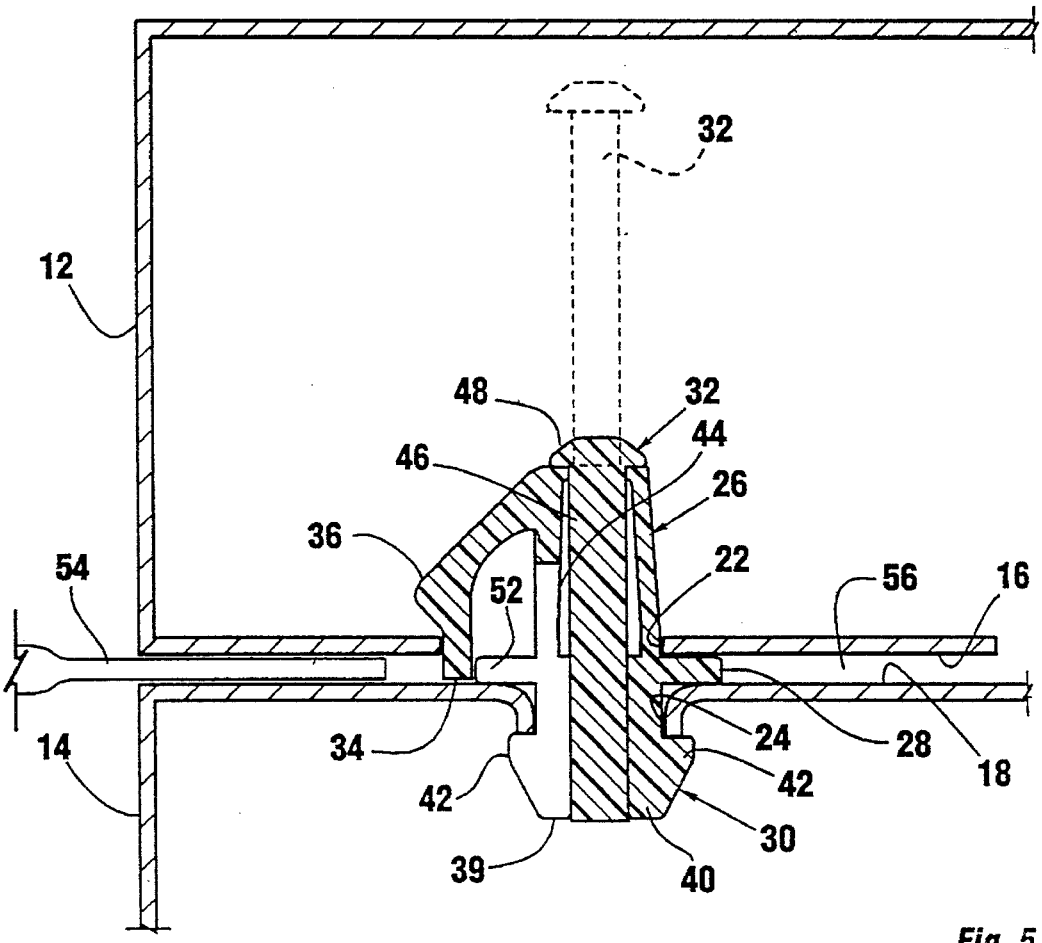
FIGS. 5 is an enlarged sectional view taken along line 5—5 of FIG. 4.

Downwardly facing surface 16 is provided with a T-shaped opening 22, and the upwardly presented surface 18 of lower cabinet member 14 is provided with a rectangular opening 24 (FIG. 5). Rectangular opening 24 is shown as an extruded opening but can also be configured as simply a punched opening through surface 18.

Figure 3:
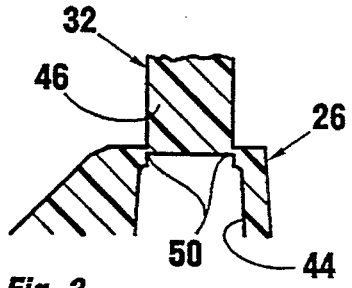
FIG. 3 is an enlarged detail sectional view taken along line 3—3 of FIG. 2.
Figure 2:
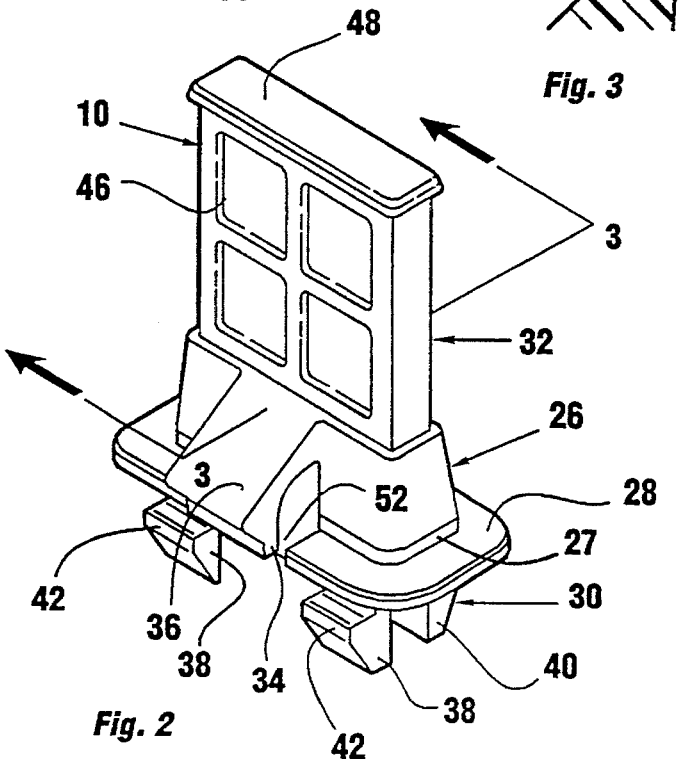
FIG. 2 is a pictorial view of the locking device after it has been molded, but before the peg has been driven between the spring legs.
Figure 4:
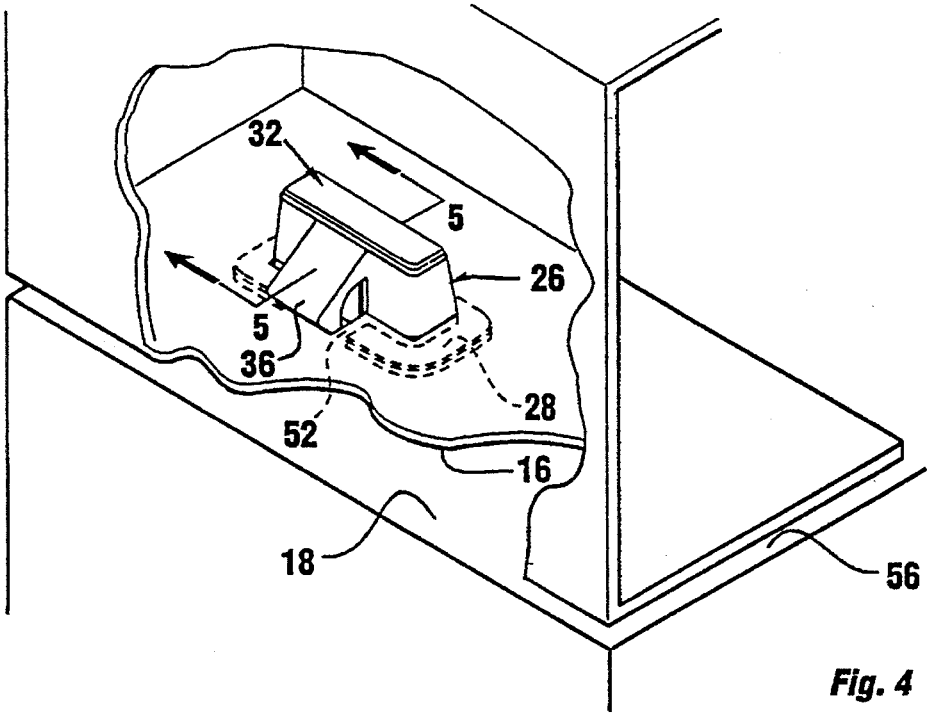
FIG. 4 is a pictorial view, partially broken away, showing the locking device in place joining the upper and lower cabinet members.

Locking device 10 comprises an upper body portion 26, a central flange 28, and a lower body portion 30. A retaining peg 32 is shown in FIGS. 2 and 3 to be molded integrally with the upper body portion 26, the central flange 28 and the lower body portion 30. It is understood that the retaining peg 32 can also be molded as a separate part and assembled to the locking device 10 when attached to the upwardly facing surface 18. Upper body portion 26 is provided with a spring pawl 34 having a camming node or knuckle 36 on the outside surface thereof. Spring pawl 34, is free to spring toward and away from the remainder of the upper body portion 26.

Lower body portion 30 includes spaced apart spring legs 38, 40 each of which has upwardly presented catch lips 42 thereon. The configuration of the legs 38, 40 and catch lips 42 will vary depending upon the thickness of the surface 18.

A vertical passageway 44 (FIG. 5) extends downwardly through the upper body portion 26, the flange 28, and between the legs 38, 40 of lower body portion 30. Retaining peg 32 includes a shank 46 and a head 48. The head 48 shown in this embodiment is optional and is not essential to the operation of the retaining peg 32. Shank 46 is shown in FIGS. 2 and 3 to be joined to the upper body portion 26 by a thin wall 50. This thin wall 50 is formed at the time of molding, and can be broken by downward pressure on peg 48 such as might be provided by a hammer. It also should be noted that the shank 46 of peg 32 is in vertical alignment with the upper end of passageway 44. As further shown in FIG. 2, the shank 46 can be cored on both sides to provide a substantially uniform wall section.

In operation, the spring legs 38, 40 are inserted into the opening 24 of the upwardly facing surface 18 of lower cabinet member 14. The distance between legs 38, 40 is slightly greater than the opening 24 so that the legs are forced to spring toward one another as they are inserted into the opening. Once the flange 28 engages the upwardly presented surface 18, the spring legs 38, 40 are free to spring outwardly to their normal position so that the catch lips 42 engage the under surface of the lower cabinet member 14 and lock the locking device 10 to the lower cabinet member 14 as shown in FIG. 1. It is noted that the locking device 10 can be attached to either the upper or lower cabinet members 12 or 14. Also, the locking device 10 can be utilized to detachably secure any appliance panels to each other.

The retaining peg 32 is driven downwardly by a hammer or other means so that it moves from the position shown in shadow lines in FIG. 5 to the position in solid lines in FIG. 5. In this position the shank 46 of peg 32 separates the legs 38, 40 and prevents them from moving inwardly. This locks the device 10 to the lower cabinet member 14.

Next, the upper cabinet member 12 is lowered over the upper portion 26 of the locking device 10 so that the opening 22 passes around the upper portion 26. During this movement, the camming node or knuckle 36 engages the downwardly presented surface 16 of upper cabinet member 12 and causes the spring pawl 34 to cam inwardly so as to permit the upper portion 26 to pass through the opening 22. Once the upper portion 26 is through the opening 22, the spring pawl 34 springs outwardly to the position shown in FIG. 5. The node 36 thus prevents the upward movement of cabinet 12 away from the position shown in FIG. 5. In this position the flange 28 creates a space 56 between the downwardly presented surface 16 of upper cabinet member 12 and the upwardly presented surface 18 of lower cabinet 14. This prevents the two from vibrating against one another during operation of the appliance. Side-to-side and front-to-back registration of the upper cabinet member 12 with respect to the lower cabinet member 14 is provided by the fit of the edges of the T-shaped opening 22 to the periphery of the upper body portion 26 of cabinet lock 10 in an area designated by numeral 27 in FIG. 2 adjacent the central flange 28.

If it becomes necessary to remove the upper cabinet 12 from its attachment with the lower cabinet 14, a screwdriver or other flat bladed tool 54 can be inserted into the space 56 so as to engage the spring pawl 34 and force it inwardly toward the remainder of the upper body portion 26. A notch 52 is provided in the flange 28 so as to provide space for this to happen. When the catch pawl 34 is forced inwardly sufficiently far to permit the node 36 to clear the aperture 22, the upper cabinet 12 can be lifted upwardly.

The locking device of the present invention is simple to manufacture. It can be molded into a single part with the peg 32 being attached to the remainder of the locking device so that the two do not become separated from one another before installation. Furthermore, the retaining peg 32 is in registered alignment with the passageway 44 so that it can be easily installed merely by forcing it downwardly. Optionally, the locking device can be molded as two separate parts and brought together during installation. The device can be used quickly to attach the upper and lower cabinet members 12, 14 together, and it prevents the two from vibrating against one another during operation of the appliance.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstances may suggest or render expedient without departing from the spirit or scope of the invention as further defined in the following claims.

We claim:

1. In an appliance cabinet assembly, the combination comprising:

a first panel member having a downwardly presented surface with a first aperture therein;

a second panel member having an upwardly presented surface with a second aperture therein;

a locking member having a base flange positioned between and preventing contact between said first and second panel members;

said base flange causing a space to be formed between said first and second panel members;

two or more spring legs extending downwardly from said base flange and protruding into said second aperture, said spring legs being biased apart from one another to retentively engage said second panel member while within said second aperture, thereby detachably securing said locking member to said second panel member;

a catch pawl connected to said base flange and protruding into said first aperture of said first panel member, said catch pawl having an upper portion retentively engaging said first panel member while in said first aperture to detachably secure said locking member to said first panel member and having a lower portion extending below said first panel member and into said space between said first and second panel members.

2. An appliance cabinet assembly according to claim 1 and further comprising a vertical space extending downwardly through said locking member from above said base flange downwardly between said spring legs and a peg frictionally fitted within said vertical space and between said spring legs to cause said spring legs to be urged away from one another and into retentive contact with said second panel member.

3. An appliance cabinet assembly according to claim 1 wherein said locking member includes an upper body portion sized to be cooperably engageable with edge portions of said first aperture to provide side-to-side and front-to-rear registration of said first panel member with said second panel member.

4. An appliance cabinet assembly according to claim 1 wherein said catch pawl is yieldably movable from a catch position retentively engaging said first panel member to a release position freeing said first panel member for movement away from said second panel member.

5. A locking device for locking first and second panel members together comprising:

a base flange having an upper surface and a lower surface;

an upper body portion extending above said base flange;

a lower body portion extending below said base flange and having spaced apart legs;

an elongated vertical passageway extending through said upper body portion, said base flange, and said lower body portion between said spaced apart legs;

a peg sized and shaped to fit within said passageway and having an upper end and a lower end, said peg operable when fitted into said passageway for moving said spaced apart legs into locking engagement with one of said first and second panel members;

said upper body portion having a catch pawl, said catch pawl having an upper pawl portion above said base flange for retentively engaging said first panel member and a lower pawl portion extending below said upper surface of said base flange.

6. A locking device according to claim 5 wherein said peg, said lower body portion, said base flange, and said upper body portion are formed of plastic material molded into a single unitary construction with a thin wall interconnecting said peg to said upper body portion, said thin wall being capable of being broken to separate said peg from said upper body portion.

7. A locking device according to claim 6 wherein said lower end of said peg is attached by said thin wall to said upper body portion with said peg in registered alignment with said vertical passageway.

8. A locking device according to claim 5 and further comprising catch surfaces on said spaced apart legs for retentively engaging one of said first and second panel members.

9. In an appliance cabinet assembly, the combination comprising:

a first panel member having a first aperture therein;

a second panel member juxtaposed to said first panel member and having a second aperture therein;

a locking member having a base flange positioned between and preventing contact between said first and second panel members and creating a space between said first and second panel members;

at least two spring legs attached to one side of said base flange and extending into one of said first and second apertures, said spring legs being biased apart from one another to retentively engage the panel member associated with said one aperture, thereby detachably securing said locking member to the panel member;

a catch pawl attached to the other side of said base flange and protruding into the other of said first and second apertures, said catch pawl retentively engaging the panel member associated with the other aperture to detachably secure said locking member to the panel member, said catch pawl having a finger portion extending downwardly into said space between said first and second panel members.

10. An appliance cabinet assembly according to claim 9 wherein said spring legs extend into said second aperture and said catch pawl protrudes into said first aperture.

* * * * *